US006710717B2

(12) United States Patent
Slomowitz et al.

(10) Patent No.: US 6,710,717 B2
(45) **Date of Patent: *Mar. 23, 2004**

(54) CRIB GATE POSITION INDICATOR

(76) Inventors: Cynthia J. Slomowitz, 33 Maple La., Glen Mills, PA (US) 19342; Scott M. Slomowitz, 33 Maple La., Glen Mills, PA (US) 19342

( * ) Notice: Subject to any disclaimer, the term of this patent is extended or adjusted under 35 U.S.C. 154(b) by 0 days.

This patent is subject to a terminal disclaimer.

(21) Appl. No.: 10/209,135

(22) Filed: Jul. 31, 2002

(65) Prior Publication Data

US 2002/0186138 A1 Dec. 12, 2002

Related U.S. Application Data

(63) Continuation of application No. 09/968,232, filed on Oct. 1, 2001, now Pat. No. 6,433,699, which is a continuation-in-part of application No. 09/843,976, filed on Apr. 27, 2001, now Pat. No. 6,476,724, which is a continuation-in-part of application No. 09/383,176, filed on Aug. 25, 1999, now Pat. No. 6,225,913.

(51) Int. Cl.[7] ..... G08B 21/00

(52) U.S. Cl. ..... 340/686.1; 340/539.15; 340/573.1

(58) Field of Search ..... 340/539.1, 539.15, 340/573.1, 573.4, 686.1, 539.16, 539.17, 539.23

(56) References Cited

U.S. PATENT DOCUMENTS

| | | | |
|---|---|---|---|
| 2,734,104 | A | 2/1956 | Gollhofer |
| 3,641,540 | A | 2/1972 | Cutler et al. |
| 3,833,895 | A | 9/1974 | Fecteau |
| 3,938,121 | A | 2/1976 | Jamison |
| 4,067,005 | A | 1/1978 | Levy et al. |
| 4,178,645 | A | 12/1979 | Cosme |
| 4,231,030 | A | 10/1980 | Weiss |
| 4,278,968 | A | 7/1981 | Arnett et al. |
| 4,640,267 | A | 2/1987 | Lawson |
| 4,826,262 | A | 5/1989 | Hartman |
| 4,924,214 | A | 5/1990 | Hill |
| 4,951,032 | A | 8/1990 | Langsam |
| 5,022,402 | A | 6/1991 | Schieberl et al. |
| 5,057,819 | A | 10/1991 | Valenti |
| 5,210,532 | A | 5/1993 | Knoedler et al. |
| D336,351 | S | 6/1993 | Freese et al. |
| 5,280,635 | A | 1/1994 | Knoedler et al. |
| 5,291,181 | A | 3/1994 | DePonte |
| 5,365,214 | A | 11/1994 | Angott et al. |

(List continued on next page.)

FOREIGN PATENT DOCUMENTS

| | | |
|---|---|---|
| DE | 3034 968 | 9/1980 |
| DE | 3204 827 | 2/1982 |

OTHER PUBLICATIONS

New Study on how to avoid crib injuries to infants and toddlers—M. V. Ridenour, Ph.D., Temple, College of Education.

BABYCOM, Practical Electronics, Nov. 1979 p. 24–27., O.N. Bishop.

*Primary Examiner*—Van Trieu
(74) *Attorney, Agent, or Firm*—Caesar, Rivise, Bernstein, Cohen & Pokotilow, L:td.

(57) ABSTRACT

A gate sensor for use with a baby crib having a displaceable gate that can be moved into an open or a closed position. The gate sensor detects the open condition of the displaceable gate and transmits a wireless signal to a remotely-located indicator. The gate sensor includes a first portion that contains a transmitter and which can be coupled to the crib or the crib gate. The gate sensor also includes a second portion that is coupled to the displaceable gate, or to the crib accordingly, for interacting with the first portion when the displaceable gate is moved into the open position to cause the first portion to transmit the wireless signal.

6 Claims, 12 Drawing Sheets

U.S. PATENT DOCUMENTS

| | | | | |
|---|---|---|---|---|
| 5,402,105 | A | | 3/1995 | Doyle et al. |
| 5,499,014 | A | | 3/1996 | Greenwaldt |
| 5,512,880 | A | | 4/1996 | Abrams et al. |
| 5,604,478 | A | | 2/1997 | Grady et al. |
| 5,629,683 | A | | 5/1997 | Slomowitz et al. |
| 5,689,236 | A | | 11/1997 | Kister |
| 5,748,074 | A | | 5/1998 | Chomet |
| 5,757,274 | A | | 5/1998 | Slomowitz et al. |
| 5,852,411 | A | | 12/1998 | Jacobs et al. |
| 5,883,579 | A | | 3/1999 | Schreiner et al. |
| 5,973,591 | A | | 10/1999 | Schwartz et al. |
| 6,084,527 | A | | 7/2000 | Spector |
| 6,114,963 | A | | 9/2000 | Blake et al. |
| 6,225,913 | B1 | | 5/2001 | Slomowitz et al. |
| 6,229,455 | B1 | | 5/2001 | Yost et al. |
| 6,433,699 | B1 | * | 8/2002 | Slomowitz et al. ..... 340/686.1 |
| 6,476,724 | B1 | | 11/2002 | Slomowitz et al. |
| 6,522,259 | B1 | | 2/2003 | Tamura |

* cited by examiner

CRIB GATE POSITION INDICATOR

RELATED APPLICATIONS

This application is a Continuation of Co-Pending application Ser. No. 09/968,232 filed Oct. 1, 2001, now U.S. Pat. No. 6,433,699, which is a Continuation-in-Part of application Ser. No. 09/843,976 filed Apr. 27, 2001, now U.S. Pat. No. 6,476,724, which is a Continuation-in-Part of application Ser. No. 09/383,176 filed Aug. 25, 1999, now U.S. Pat. No. 6,225,913, all of which are entitled CRIB GATE POSITION INDICATOR and all of whose entire disclosures are incorporated by reference herein.

FIELD OF THE INVENTION

This invention relates generally to indicators and, more particularly, to electronic position indicators for the gate of a crib.

BACKGROUND OF THE INVENTION

Most baby cribs comprise a mattress located within a bed frame having four sides, with each side comprising vertical bars positioned between a top molding and a bottom molding. Two opposing sides are vertically displaceable, known as a crib gate, in either a raised (closed) condition or in a lowered (open) position. Lowering the gate is accomplished by displacing a footbar (located at the bottom and just under the bottom molding) which disengages a bottom molding catch from the footbar and then allows the gate to drop downward. Raising the gate is accomplished by simply lifting the gate upwards until the bottom molding catch re-engages the footbar, thereby locking the gate in a raised position.

In most instances, the parent or infant-caretaker will be holding or rocking the baby to sleep. When the parent or infant-caretaker is ready to place the baby on the mattress, the gate is lowered as discussed previously. Usually, the parent or infant caretaker is so focused on positioning the infant on the mattress without waking the infant that frequently the parent or infant-caretaker forgets to raise the gate after the infant is placed on the mattress. The result is that the infant is left in a crib with the gate down. If the infant is old enough to roll and raise himself/herself, the infant could fall out of the crib at a later time because the crib gate remains in an open condition.

Moreover, a recent study conducted by a Temple University researcher has recommended increasing the side heights of cribs to reduce the number of falls from cribs. If this recommendation is followed, the opening and closing of the crib gate by the parent/caregiver should occur more often since raising the height of the crib sides makes it more difficult to place or lift a toddler from the crib without opening the gate. As a result, this increases the chances that a parent/caregiver may walk away from a crib with the toddler inside and with the crib gate left open.

The following U.S. patents disclose some form of indication or warning in association with a baby crib or bed.

U.S. Pat. No. 2,734,104 (Gollhofer) discloses an alarm for alerting an attendant that the crib gate is in a down position.

U.S. Pat. No. 4,231,030 (Weiss) discloses a safety device for a crib that provides an indicating light or an alarm at the crib to alert a person to the fact that the crib gate is in a down position.

U.S. Pat. No. 4,951,032 (Langsam) discloses a crib rail safety monitor that utilizes a weight sensor for detecting the presence of a child in the crib and an ultrasonic motion detector or infrared temperature sensor for detecting the presence of an attendant at the crib in order to provide an indication or alarm at the crib that the crib gate is down when the child is in the crib and is unattended.

U.S. Pat. No. 5,057,819 (Valenti) discloses a safety cushion device that is positioned on the floor adjacent the baby crib for cushioning the fall of a child and an alarm for alerting an adult of such a fall.

U.S. Pat. No. 5,291,181 (DePonte) discloses a wet bed alarm and temperature monitoring system for detecting urine on the bed and the temperature of a person lying on the bed and for supplying a remote annunciator panel with such information.

U.S. Pat. No. 5,629,683 (Slomowitz et al.), whose entire disclosure is incorporated by reference herein, discloses an automatic crib gate indicator that utilizes a remote-enabling means to enable a crib gate sensor that detects the open condition of the crib gate and then transmits a signal to a remotely located indicator.

U.S. Pat. No. 5,757,274 (Slomowitz et al.), whose entire disclosure is incorporated by reference herein, discloses an automatic crib gate indicator that utilizes a crib gate sensor, for detecting the open condition of the crib gate, that is integrated with a baby monitoring system.

U.S. Pat. No. 6,225,913 (Slomowitz et al.) discloses an automatic crib gate indicator that utilizes a crib gate sensor for detecting the open condition of the crib gate.

However, there remains a need to provide a more durable crib gate sensor for a crib gate position indicator that provides the parent or infant-caretaker with an automatic remotely-located indication or warning of the crib gate being left in an open condition.

SUMMARY OF THE INVENTION

A gate sensor for use with a baby crib having a displaceable gate (e.g., a vertically-displaceable gate, a rotatably-displaceable gate, etc.) that can be moved into an open or a closed position. The gate sensor detects the open condition of the displaceable gate and transmits a wireless signal to a remotely-located indicator (e.g., a dedicated remote indicator, a parent unit of a baby monitoring system which includes a "crib gate open indicator"). The gate sensor comprises: a first portion containing a transmitter coupled to a crib; and a second portion coupled to the displaceable gate wherein the second portion interacts (e.g., by contact, or non-contact interaction) with the first portion when the displaceable gate is moved into the open position to cause the first portion to transmit the wireless signal.

A gate sensor for use with a baby crib having a displaceable gate that can be moved into an open or a closed position. The gate sensor detects the open condition of the displaceable gate and transmits a wireless signal to a remotely-located indicator (e.g., a dedicated remote indicator, a parent unit of a baby monitoring system which includes a "crib gate open indicator"). The gate sensor comprises: a first portion containing a transmitter coupled to the displaceable gate; and a second portion coupled to the crib wherein the second portion interacts (e.g., by contact, or non-contact interaction) with the first portion when the displaceable gate is moved into the open position to cause the first portion to transmit the wireless signal.

A gate sensor for use with a baby crib having a displaceable gate (e.g., a vertically-displaceable gate) that can be moved into an open or a closed position. The gate sensor detects the open condition of the displaceable gate and transmits a wireless signal to a remotely-located indicator (e.g., a dedicated remote indicator, a parent unit of a baby monitoring system which includes a "crib gate open indicator"). The gate sensor comprises: a housing including a pair of downwardly-directed members extending from each end of a central portion, and wherein the central portion is disposed on a horizontal support surface located at a lower part of the crib. The housing includes: a microphone and transmitter for detecting the sounds of the infant or toddler placed in the crib and for generating a wireless signal representative of the sounds; a switch interfaced with the displaceable gate and electrically coupled to a signal generator to a power source whenever the displaceable gate is in an open condition to form a crib gate open condition signal; and wherein the signal generator has an output coupled to the transmitter for incorporating the crib gate open condition signal into the wireless signal.

A method for detecting the open condition of a displaceable gate (e.g., a vertically-displaceable gate, a rotatably-displaceable gate, etc.) of a crib. The method comprises the steps of: coupling a first member comprising a transmitter to the crib; coupling a second member to the displaceable gate; and wherein the first member and the second member interact (e.g., by contact, or non-contact interaction) with each other to cause the transmitter to transmit a wireless signal to a remote indicator (e.g., a dedicated remote indicator, a parent unit of a baby monitoring system which includes a "crib gate open indicator") whenever the displaceable gate is opened.

A method for detecting the open condition of a displaceable gate (e.g., a vertically-displaceable gate, a rotatably-displaceable gate, etc.) of a crib. The method comprises the steps of: coupling first member comprising a transmitter to the displaceable gate; coupling a second member to the crib; and said first member and said second member interacting (e.g., by contact, or non-contact interaction) with each other to cause said transmitter to transmit a wireless signal to a remote indicator (e.g., a dedicated remote indicator, a parent unit of a baby monitoring system which includes a "crib gate open indicator") whenever the displaceable gate is opened.

DESCRIPTION OF THE DRAWINGS

Many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 3:
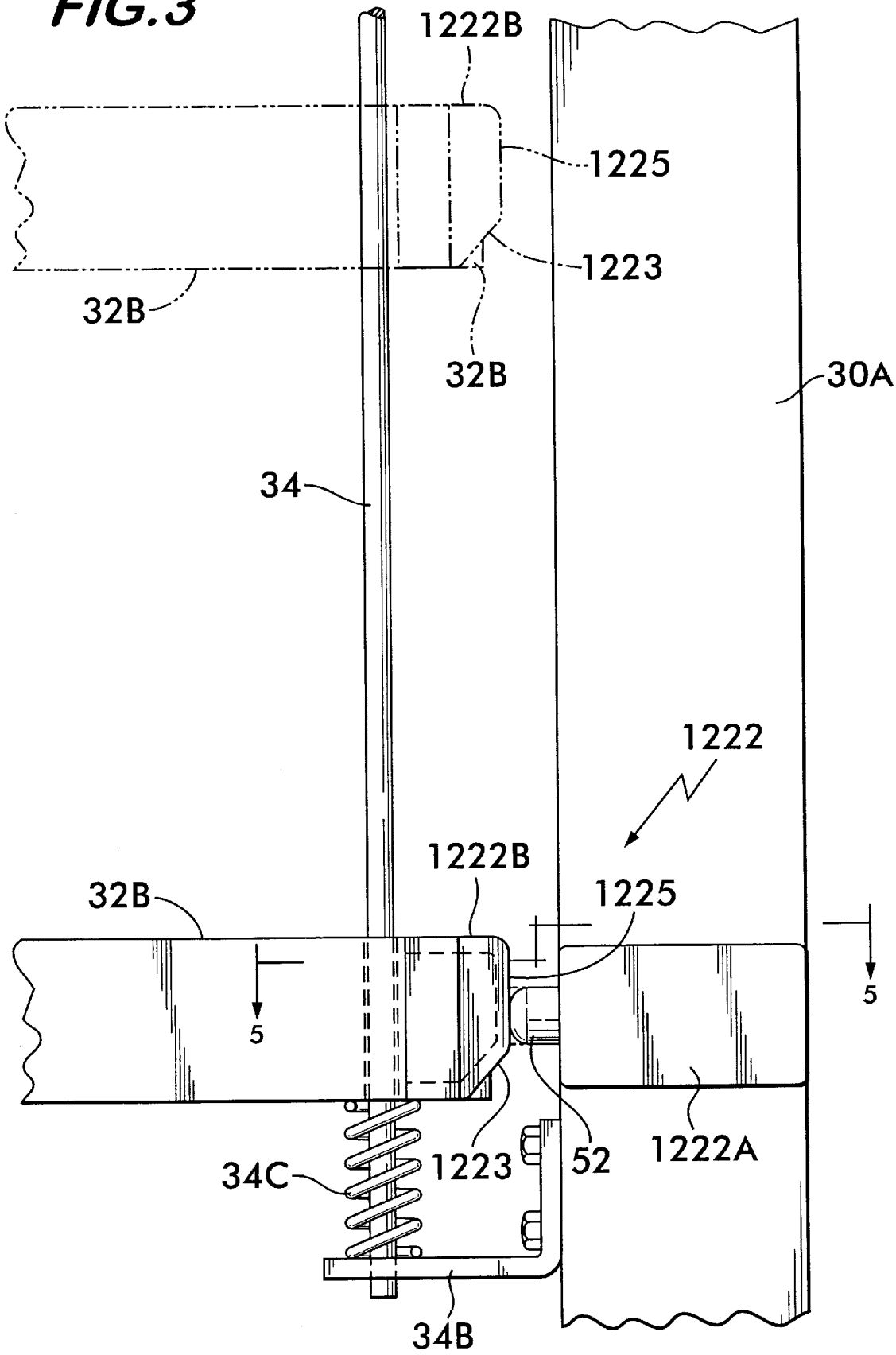
FIG. 3 is a partial side view of the crib showing the gate sensor of the present invention mounted to the crib, with crib gate being shown in a closed position (shown in phantom) and with the crib gate being shown in an open position activating the gate sensor.

Referring now in greater detail to the various figures of the drawing wherein like reference characters refer to like parts, there is shown generally at 1222 in FIG. 3, a gate sensor that forms a portion of a crib gate position indicator as set forth in U.S. Pat. Nos. 5,629,683 (Slomowitz et al.), 5,757,274 (Slomowitz et al.) and 6,225,913 (Slomowitz et al.), all of whose entire disclosures are incorporated by reference herein, and as set forth in application Ser. No. 09/843,976 whose entire disclosure is also incorporated by reference herein.

Figure 1:
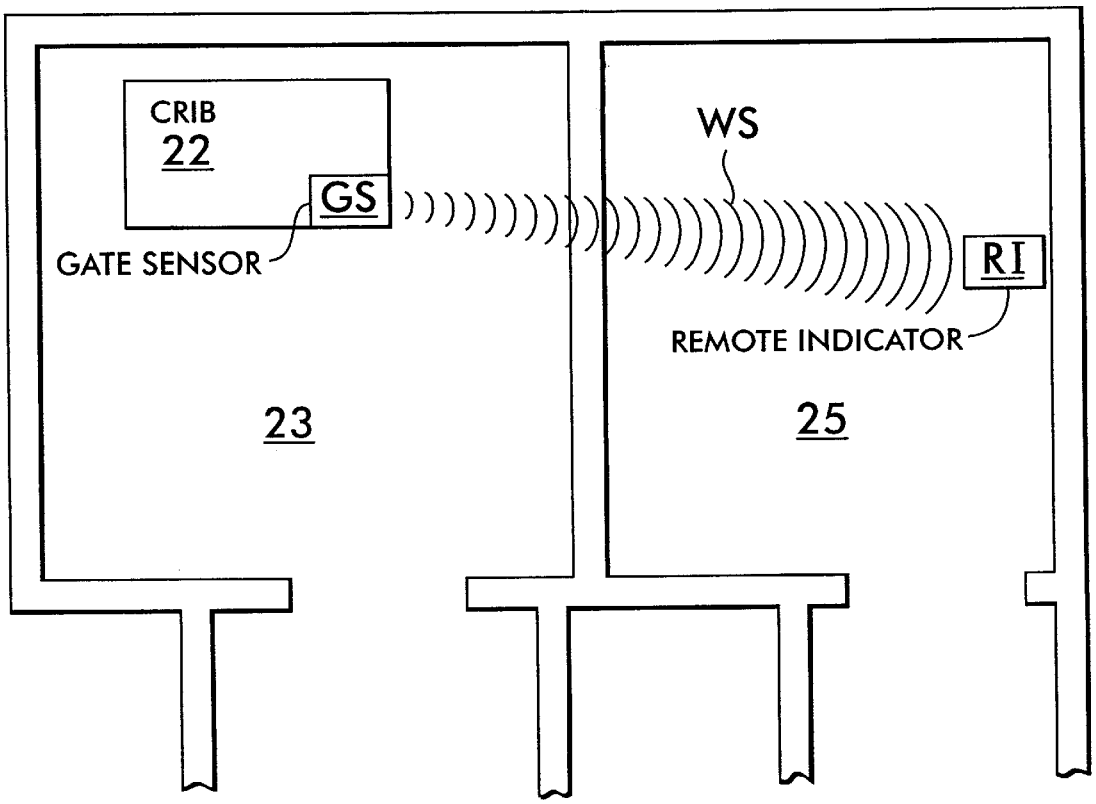
FIG. 1 is a top plan view of a home showing a crib gate position indicator of U.S. Pat. Nos. 5,629,683 (Slomowitz et al.), 5,757,274 (Slomowitz et al.) and 6,225,913 (Slomowitz et al.), and application Ser. No. 09/843,976 having a gate sensor coupled to a conventional baby crib which is at one location in the home and a remote indicator positioned at another remote location in the home.

In general and as shown in FIG. 1, the crib gate position indicator in the above-identified patents and patent application basically comprise a gate sensor GS coupled to a crib 22 located in a baby room 23 and a remote indicator RI (e.g., a dedicated remote indicator, or a parent unit of a baby monitoring system having a crib gate open indicator, etc.) positioned at another location 25, remote from the crib 22. When the crib gate is moved into an open position, the gate sensor GS detects this open condition and then transmits a wireless signal WS to the remote indicator RI to alert the parent or caregiver to close the crib gate; once the gate is closed, the gate sensor GS is de-activated.

Figure 2:
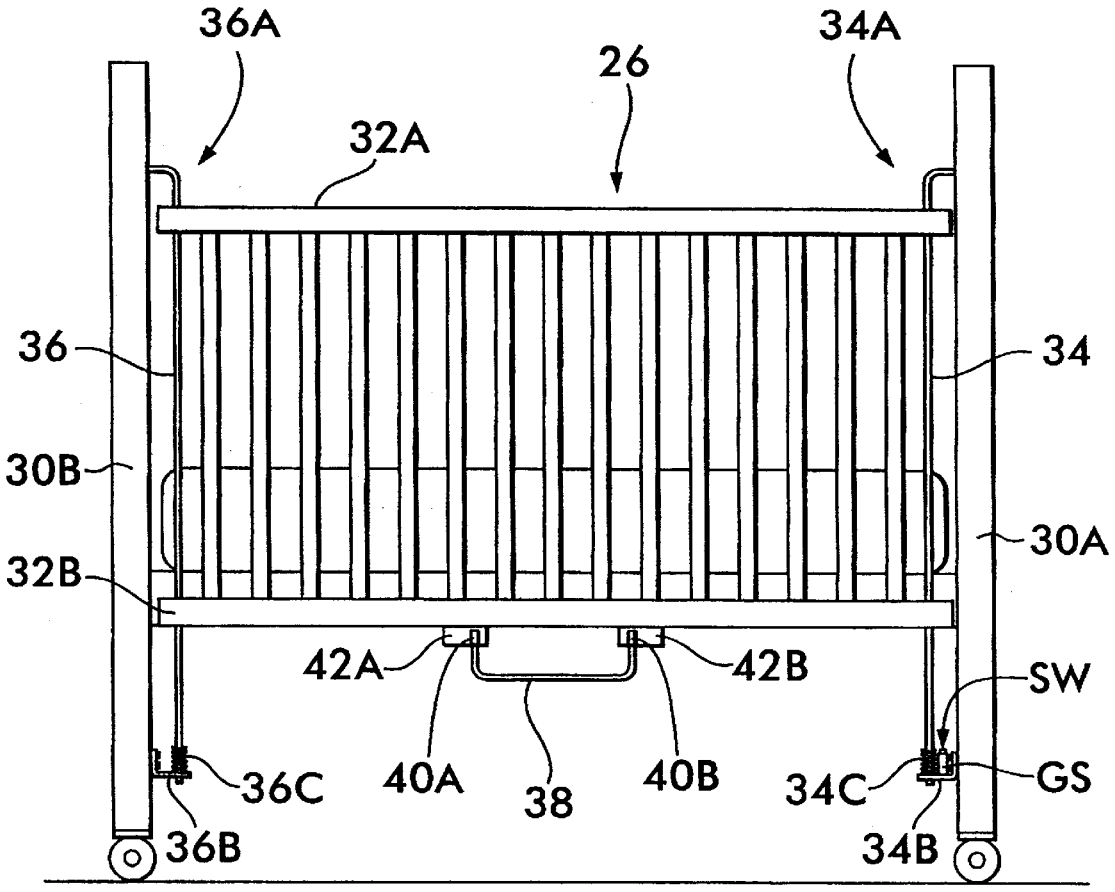
FIG. 2 is a side view of the crib of FIG. 1 with the gate sensor coupled thereto.

By way of example only, FIG. 2 depicts a conventional crib 22 having a vertically-displaceable gate showing the gate sensor GS coupled thereto. With particular regard to the conventional crib 22 of FIG. 2, the crib gate 26 comprises an upper molding 32A and a lower molding 32B. The moldings have respective holes (not shown) that align to allow the crib gate 26 to be vertically displaceable along a first slide rod 34 and a second slide rod 36. The slide rods 34 and 36 are fixedly secured to crib legs 30A and 30B at their respective top ends 34A and 36A. In addition, the slide rods 34 and 36 are fixedly secured to crib legs 30A and 30B at their respective bottom ends by respective support plates 34B and 36B. To cushion the weight of the gate 26 when the gate is down, the lower molding 32B rests on a pair of support springs 34C and 36C. The crib gate 26 is designed to be in either one of two states: an open (gate-down) condition or a closed (gate-up) condition. FIG. 2 shows the crib gate 26 in a closed (gate-up) condition. Coupled to the underside of the mattress support is a pivoting footbar 38. The footbar 38 is pivotally coupled to the mattress support and is spring-loaded such that whenever there is no countering force by the parent's or infant caretaker's foot, two prongs 40A and 40B, located on the footbar 38, are positioned in the plane of vertical displacement of the gate 26. These prongs 40A and 40B engage two corresponding catch plates 42A and 42B positioned on the bottom surface of the lower molding 32B. Hence, when these prongs 40A and 40B engage the corresponding catches 42A and 42B, the crib gate 26 is in the closed (gate-up) position. To open the gate, the parent or infant-caretaker pivots the footbar 38 by pushing the footbar 38 towards the center of the crib 22 (into the plane of FIG. 2), thereby disengaging the prongs 40A and 40B from the corresponding catches 42A and 42B. Such disengagement allows the crib gate 26 to drop down. In this position, the bottom surface of the lower molding 32B rests on cushioning springs 34C and 36C. To close the gate, the parent or infant-caretaker simply pulls the upper molding 32A upward until the corresponding catches 42A and 42B re-engage the prongs 40A and 40B on the footbar 38, thereby locking the crib gate 26 in a closed (gate-up) condition. Activation of the gate sensor GS occurs when the lower molding 32B contacts a switch SW on the GS which activates an internal transmitter (not shown) in the gate sensor GS to transmit the wireless signal WS; the signal WS is received by an internal receiver (not shown) in the remote indicator RI, thereby causing the remote indicator RI to alert (by a visual indicator or sound, etc.) the parent or caregiver that the crib gate is in an open condition. De-activation of the gate sensor GS occurs when the crib gate 26 is raised such that the lower molding 32A no longer contacts the switch SW.

The improvement of the present invention, gate sensor 1222, as shown in FIG. 3, is to interface the gate sensor GS with the crib 22 so as to avoid having the weight of the crib gate 26 on the gate sensor GS itself.

Figure 4:
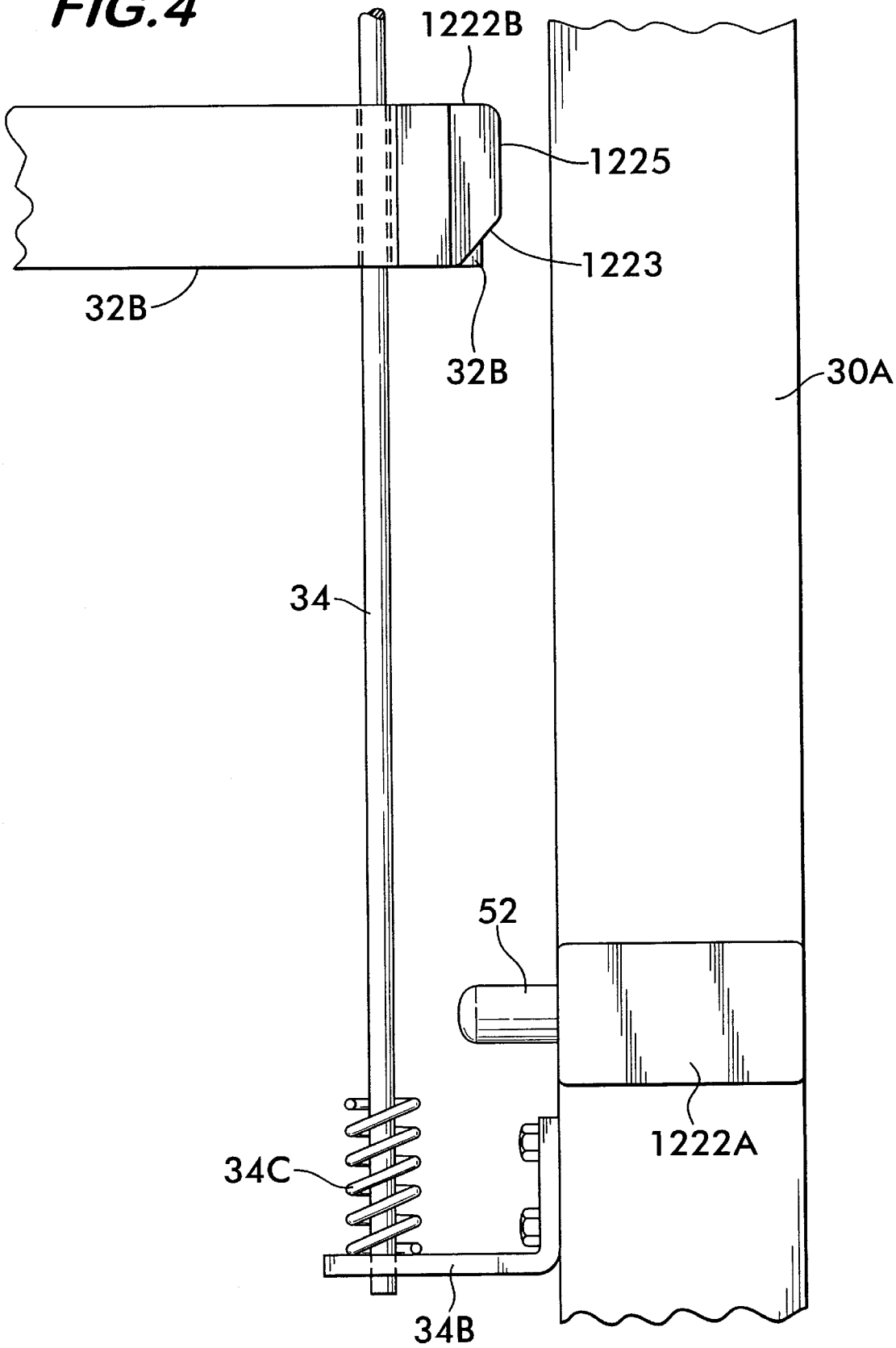
FIG. 4 is a partial side view of the crib showing the crib gate in a closed position and with the gate sensor in a de-activated state.

In particular, the gate sensor 1222 comprises a first portion 1222A that is adjustably coupled to a crib leg 30A and a second portion 1222B coupled to one end of the lower molding 32A. The first portion 1222A comprises the electronics as set forth in U.S. Pat. Nos. 5,629,683 (Slomowitz et al.), 5,757,274 (Slomowitz et al.) and 6,225,913 (Slomowitz et al.) and in application Ser. No. 09/843,976, including the switch 52 for activating the gate sensor 1222 and for transmitting the wireless signal WS. The second portion 1222B comprises a durable material (e.g., ABS, plastic, etc.) having a first tapered edge 1223, along which the switch 52 rides as the lower molding 32B is moved downward when the crib gate 26 is opened. As the switch 52 is driven inward by the tapered edge 1223, the transmitter (not shown) in the first portion 1222A transmits the wireless signal WS, thereby activating the remote indicator RI. When the lower molding 32B comes to rest on the support spring 34C, a forward end 1225 of the second portion 1222B (as shown in the lower portion of FIG. 3) holds the switch 52 inward to maintain the transmitter activation. Conversely, when the crib gate 26 is lifted upward to the closed position (FIG. 4), the switch 52 rides along the tapered edge 1223 in the reverse direction. Once the switch 52 disengages from the tapered edge 1223, the transmitter stops transmitting the wireless signal WS and the remote indicator RI is de-activated.

Figure 5:
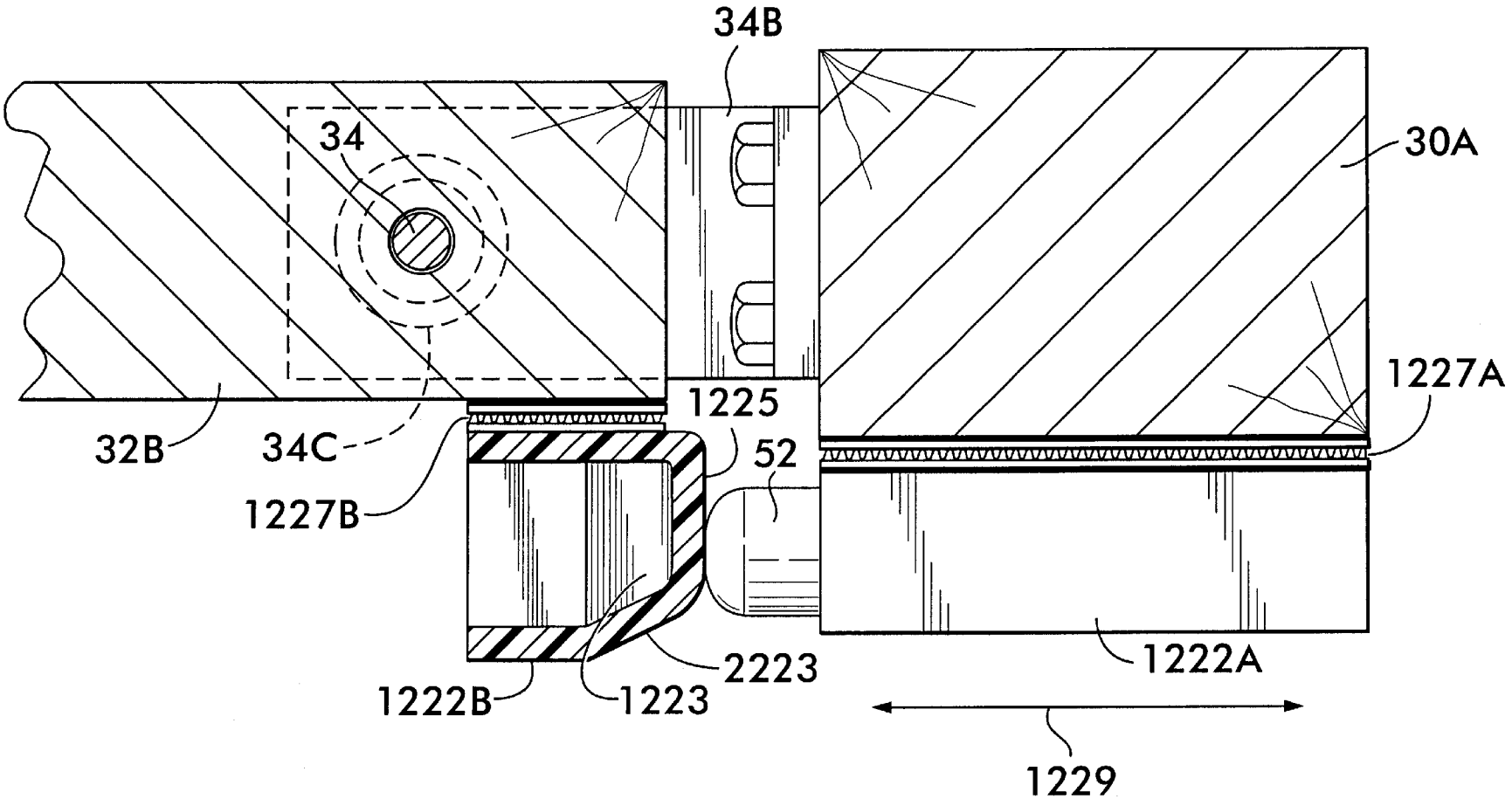
FIG. 5 is a partial cross-sectional view taken along line 5—5 of FIG. 3.

As can be seen most clearly in FIG. 5, both the first portion 1222A and the second portion 1222B can adjustably coupled to the crib 22. For example, using a hook and pile 1227A (e.g., VELCRO®), the first portion 1222A can be adjusted in the directions indicated by the line 1229 to make proper contact with the tapered edge 1223 of the second portion 1222B; similarly, the second portion 1222B can be adjusted in the directions indicated by the line 1229 using a hook and pile 1227B to have the tapered edge 1223 make proper contact with the switch 52 of the first portion 1222A.

It should be understood that the locations of the first and second portions 1222A/1222B can be interchanged such that the first portion 1222A is located on the lower molding 32B and the second portion 1222B is located on the crib leg 30A, without deviating from the scope of this invention.

Figure 6:
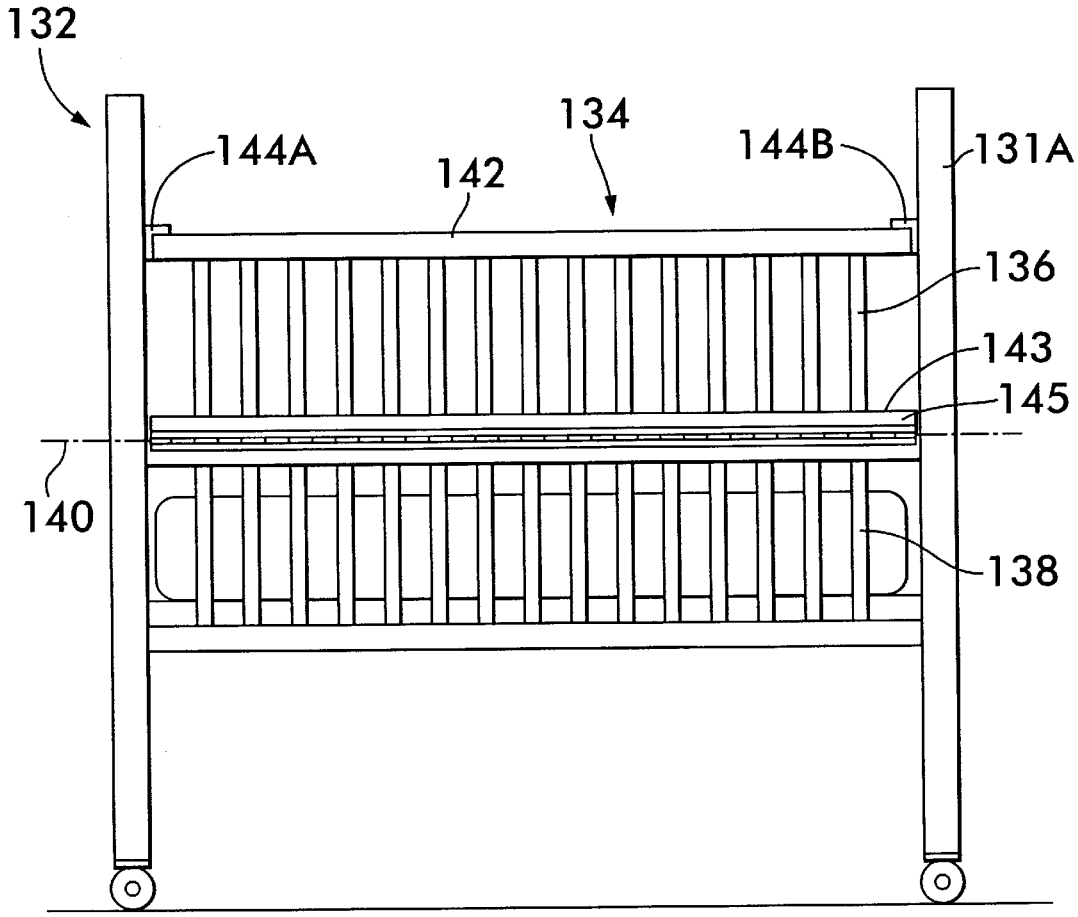
FIG. 6 is a side view of another conventional crib having a rotating gate.
Figure 7:
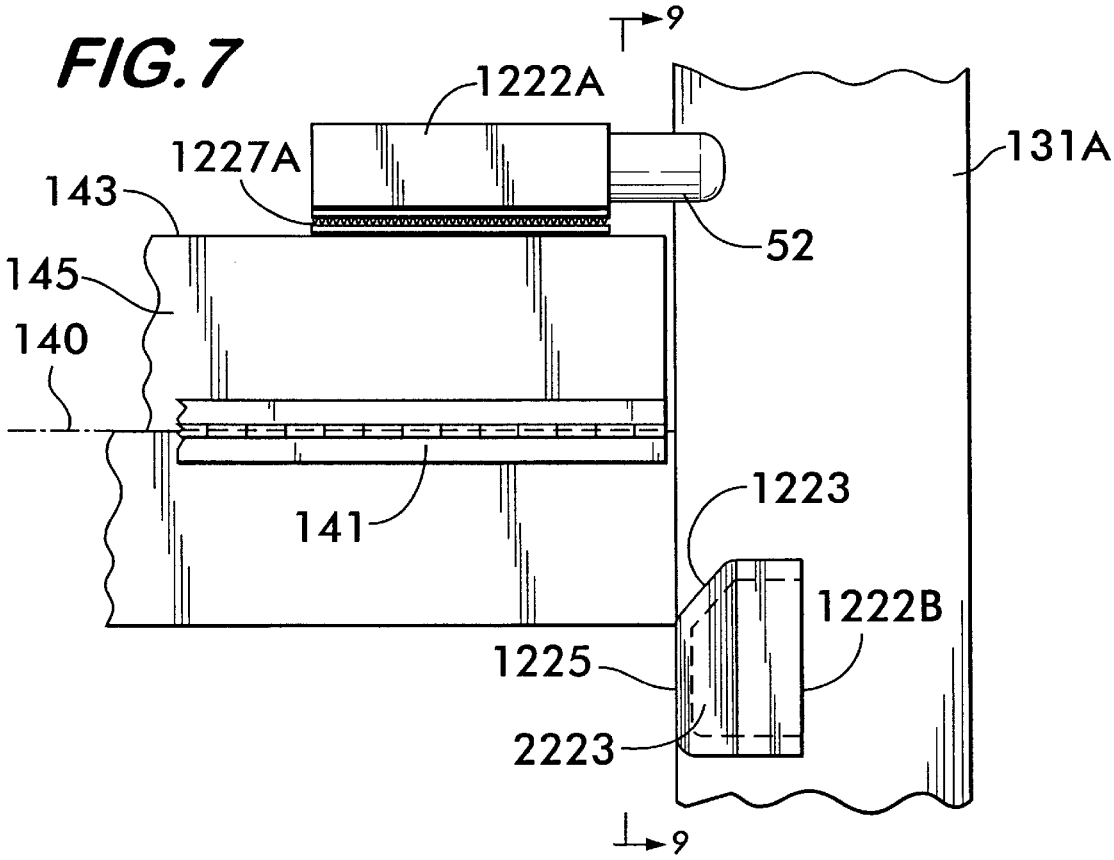
FIG. 7 is a partial side view of the crib of FIG. 6 showing the gate sensor of the present invention mounted to the crib, with the crib gate being shown in a closed position and with the gate sensor in a de-activated condition.

It should also be noted that it is also within the broadest aspect of this invention to have the gate sensor 1222 be compatible with a variety of displaceable gate cribs, such as a Gerry Wood Products, Inc. Model 85 crib. For example, there is shown in FIG. 6, a crib 132 having a crib gate 134 that has a rotatable upper portion 136 and fixed lower portion 138. In particular, the upper portion 136 rotates about an axis 140 away from the crib interior (out of the plane of the paper in FIG. 6), thereby opening the gate 134. A hinge 141 (FIG. 7) rotatably couples the upper portion 136 to the fixed lower portion 138. The ends of the upper molding 142 are releasably press-fit into catches 144A and 144B by the parent or infant-caretaker to close the gate 134. Pressure on the upper molding 142 away from the crib interior disengages the ends of the upper molding 142 from the catches 144A and 144B, thereby opening the gate 134. FIG. 6 depicts the crib gate 134 in a closed condition.

Figure 8:
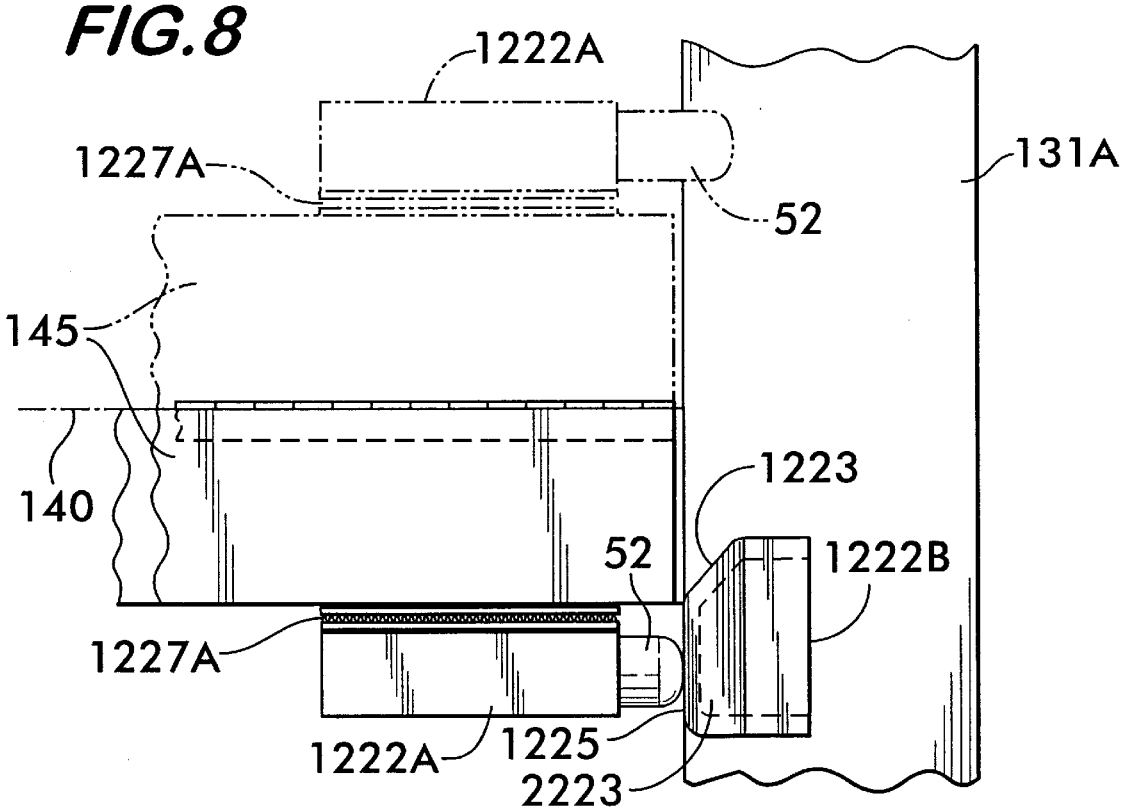
FIG. 8 is a partial side view of the crib of FIG. 6 showing the gate sensor of the present invention mounted to the crib, with crib gate being shown in a closed position (shown in phantom) and with the crib gate being shown in an open position activating the gate sensor.
Figure 9:
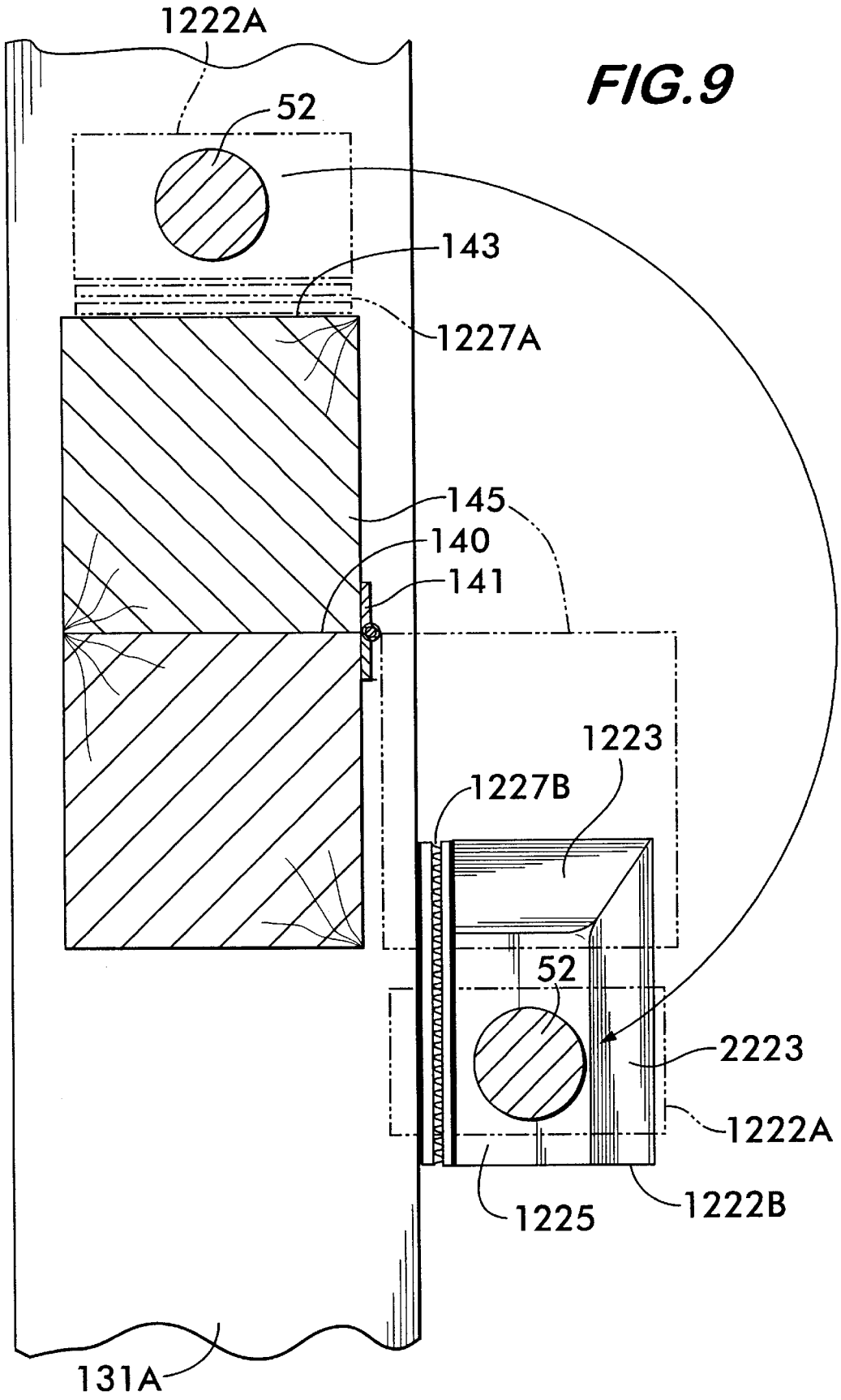
FIG. 9 is a partial cross-sectional view taken along line 9—9 of FIG. 7.

In particular, the first portion 1222A can be adjustably mounted on the upper surface 143 of the molding 145 using the hook and pile 1227A (e.g., VELCRO®). Similarly, the second portion 1222B can also be adjustably mounted on the crib leg 131A using the hook and pile 1227B (FIG. 9). To permit the second portion 1222B to be used for the crib 132 also, a second tapered edge 2223 is provided on the second portion 222B. Thus, when the upper portion 136 is rotated downward, as shown in FIGS. 8 and 9, the switch 52 makes contact with and rides along the tapered edge 2223, thereby causing the transmitter (not shown) in the first portion 1222A to transmit the wireless signal WS and to activate the remote indicator RI. Once the switch 52 encounters the edge 1225 on the second portion 1222B, the switch 52 is held in place to maintain the transmitter activation. Conversely, when the upper portion 136 is rotated upward (FIG. 7), the switch 52 rides along the tapered edge 2223 in the reverse direction. Once the switch 52 disengages from the tapered edge 2223, the transmitter stops transmitting the wireless signal WS and the remote indicator RI is de-activated.

It should be understood that the locations of the first and second portions 1222A/1222B can be switched such that the first portion 1222A is located on the crib leg 131A and the second portion 1222B is located on the upper surface 143 of the molding 145, without deviating from the scope of this invention.

Thus, the gate sensor 1222 can be adapted to existing cribs for use in the various crib gate position indicators set forth in U.S. Pat. Nos. 5,629,683 (Slomowitz et al.), 5,757,274 (Slomowitz et al.) and 6,225,913 (Slomowitz et al.) and in application Ser. No. 09/843,976.

Figure 10A:
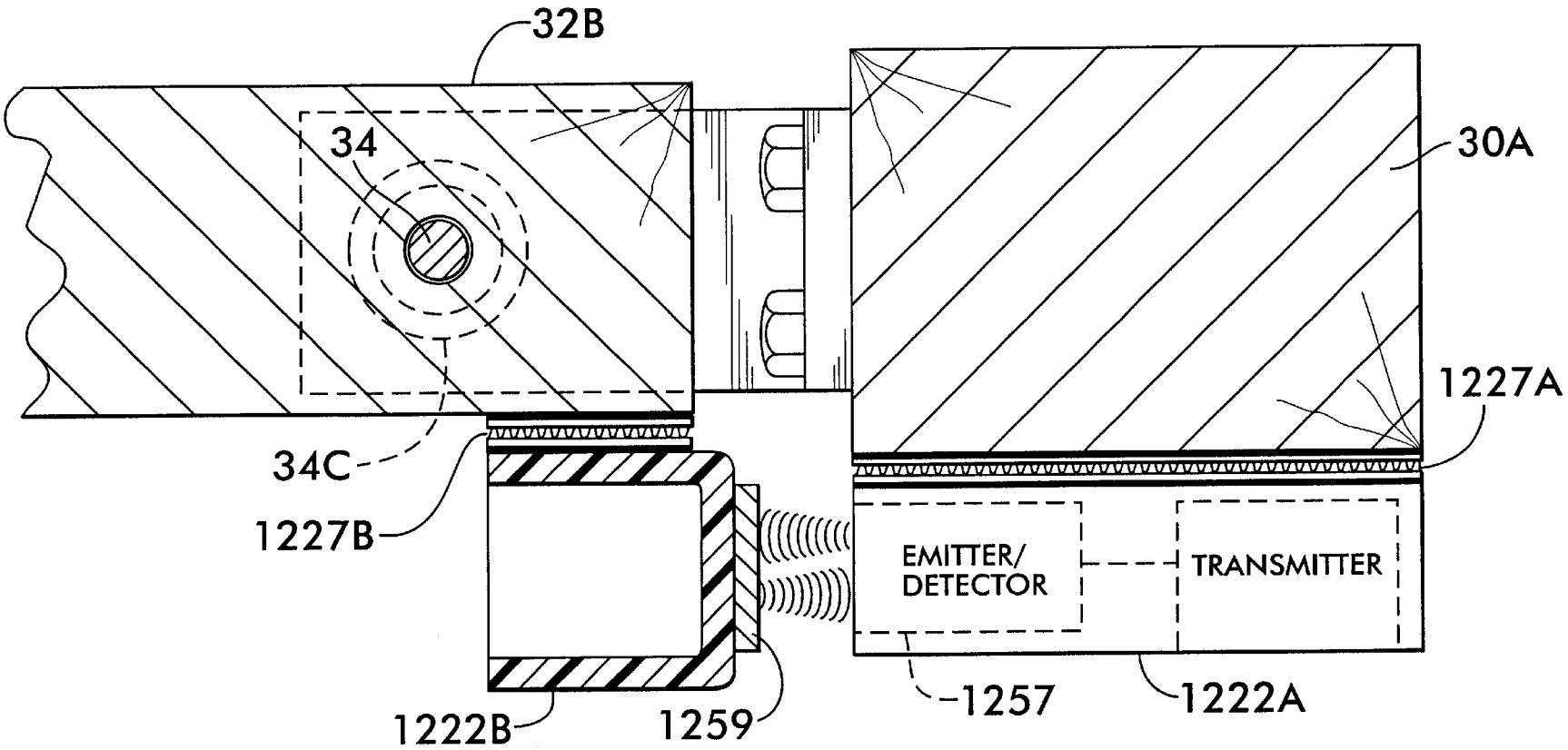
FIG. 10A is a partial cross-sectional view taken along line 5—5 of FIG. 3 but with the switch of the first portion replaced with an emitter/detector and a target replacing the tapered edges of the second portion.
Figure 10B:
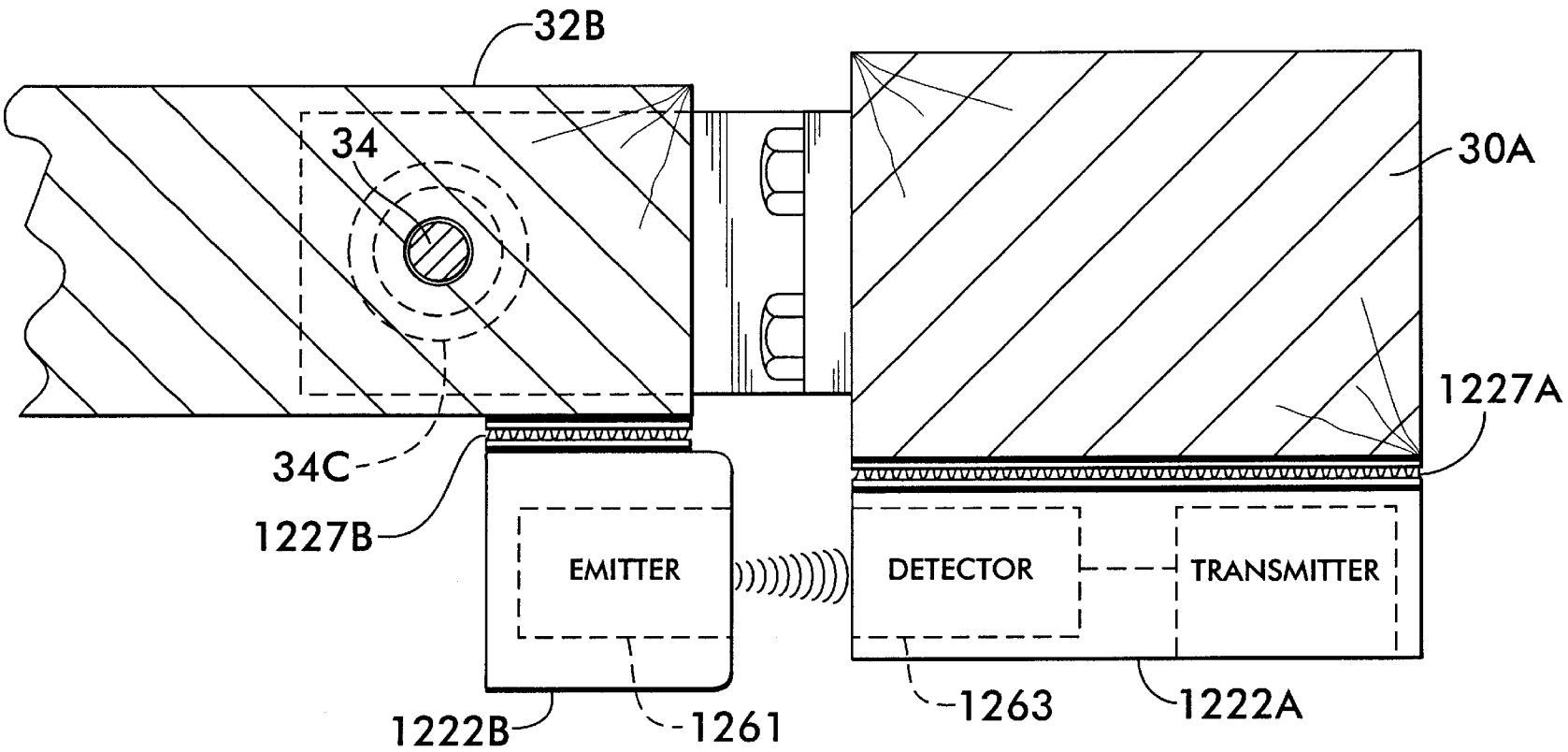
FIG. 10B is a partial cross-sectional view taken along line 5—5 of FIG. 3 but with the switch of the first portion replaced with a detector and an emitter replacing the tapered edges of the second portion.
Figure 11A:
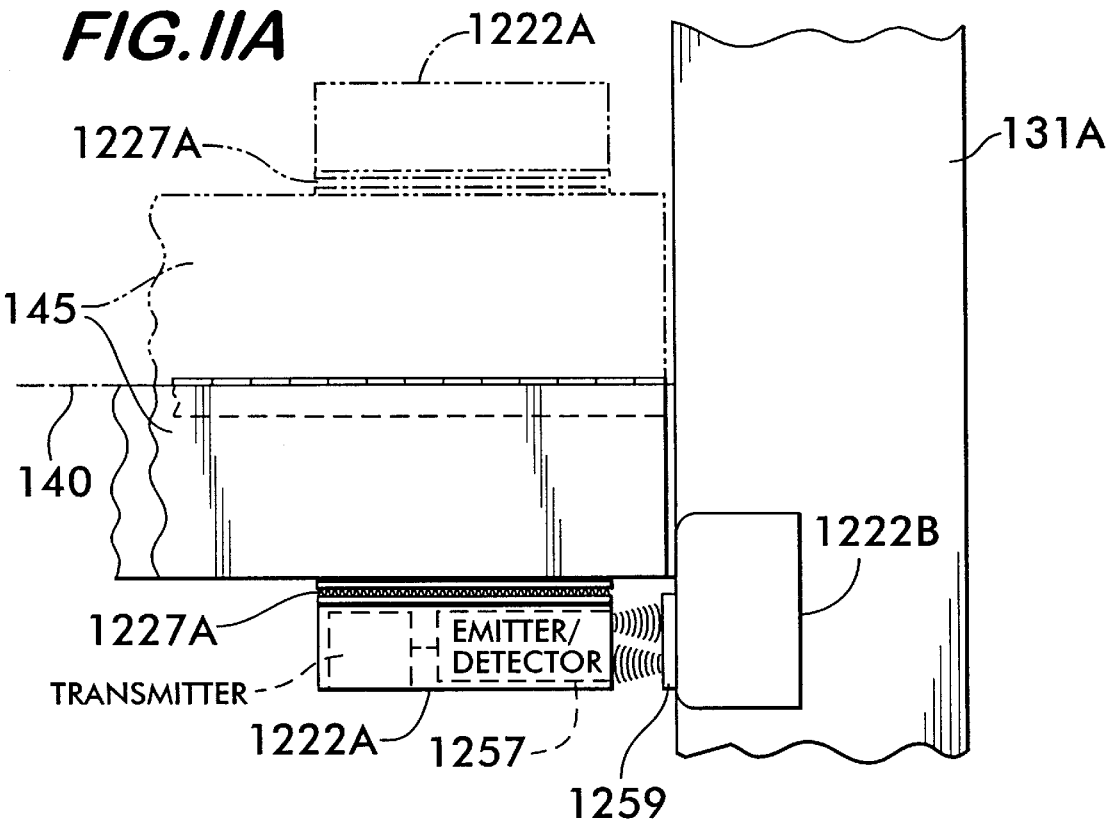
FIG. 11A is similar to the view of FIG. 8 but with the switch of the first portion replaced with a detector and an emitter replacing the tapered edges of the second portion.
Figure 11B:
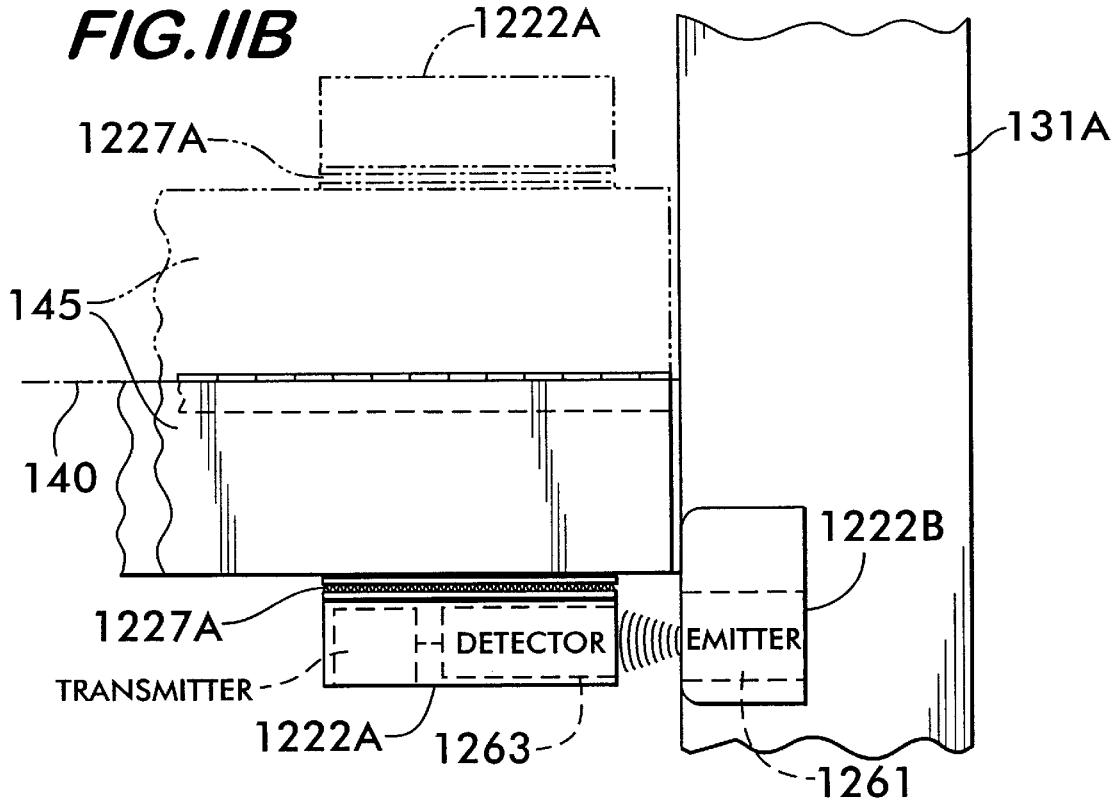
FIG. 11B is similar to the view of FIG. 8 but with the switch of the first portion replaced with a detector and an emitter replacing the tapered edges of the second portion.

It should be understood that, as set forth in these patents and patent application, the switch 52 is by way of example only and that any similar or equivalent means, or other non-contact interaction means, for detecting the open position of the crib gate 26/136 (e.g., a proximity switch, a magnetically-coupled sensor, Hall effect sensor, etc. such as those shown in U.S. Pat. Nos. 4,278,968 (Arnett et al.); 5,365,214 (Angott et al.); 5,499,014 (Greenwaldt); and 5,689,236 (Kister), all of whose disclosures are incorporated by reference herein) is covered by the scope of the present invention. Thus, for example, the switch 52 of the first portion 1222A can be substituted with any well-known in the art emitter/detector (electrical, magnetic, ultrasonic, optical, including infrared, etc.) and the tapered edges 1223/2223 of the second portion can be substituted with a passive target (conductive, capacitive, inductive, reflective, opaque, etc.). In particular, the first portion 1222A of the gate sensor 1222 for use with a vertically-displaceable gate (FIG. 10A) and a rotatably-displaceable gate (FIG. 11A) may comprise an emitter/detector 1257 while the tapered edges 1223/2223 of the second portion 1222B are replaced with a passive target 1259. In use, the emitter/detector 1257 emits a signal (electrical, magnetic, ultrasonic, infrared, optical, etc.) that reflects or couples with the passive target 1259, when the gate 26/136 is in an open condition, thereby causing a new signal to be detected by the detector 1257 which activates the transmitter to emit the wireless signal WS. Alternatively, as shown in FIG. 10B for a vertically-displaceable gate 26 and in FIG. 11B for a rotatably-displaceable gate 136, the second portion 1222B may comprise an emitter 1261 (which replaces the tapered edges 1223/2223) while the first portion 1222A may comprise a detector 1263 (which replaces the switch 52). In use, the emitter 1261 emits a signal (electrical, magnetic, ultrasonic, infrared, optical, etc.) that is detected by the detector 1263 when the crib gate 26/136 is in an open condition and wherein the detector 1263 then activates the transmitter to emit the wireless signal WS.

It should be understood that the relative locations of the first and second portions 1222A/1222B using these non-contact configurations can be interchanged, i.e., which portion 1222A/1222B is located on a fixed portion of the crib and which portion is located on the displaceable gate, without deviating from the scope of the present invention.

As mentioned earlier, the important feature of the present invention is that the gate sensor 1222 is activated by the open condition of the crib gate 26/136 but without the need for the crib gate to rest upon the gate sensor 1222.

Figure 12:
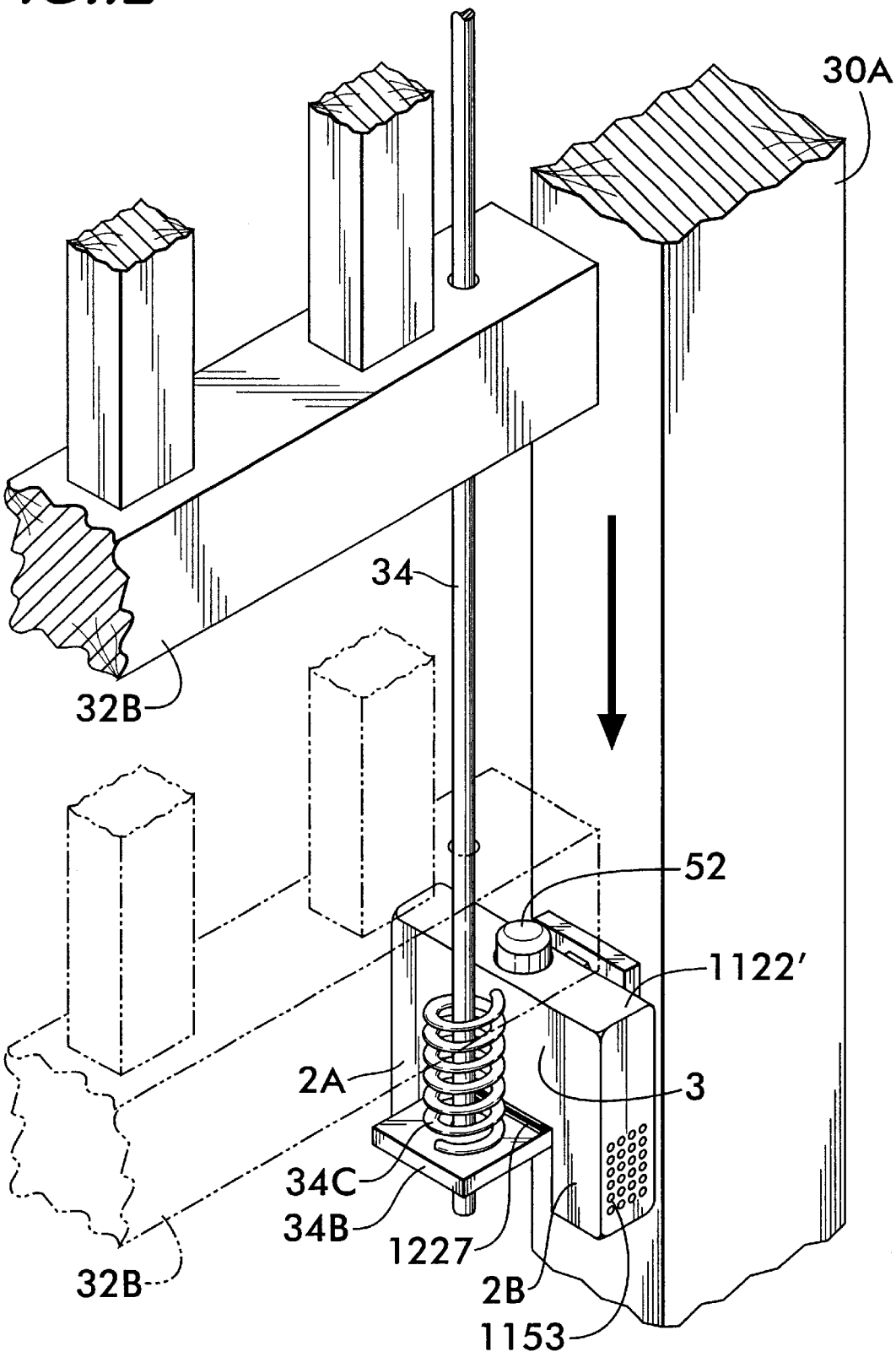
FIG. 12 is an isometric view of a variation of the gate sensor of A.S.N. 09/843,976.

FIG. 12 depicts a variation of the gate sensor 1122 of application Ser. No. 09/843,976. In particular, FIG. 12 shows gate sensor 1122' for use with a vertically-displaceable crib gate 26. The gate sensor 1122' utilizes a housing having two downwardly-directed members 2A and 2B extending from each side of a central portion 3. When used, the central portion 3 of the gate sensor 1122' is positioned on one of the support plates 34B. A hook and pile 1227 may be used between the support plate 34B and the bottom surface of the central portion 3 to secure the gate sensor 1122' to the crib 22; in addition, the downwardly-directed members 2A and 2B further secure and help stabilize the gate sensor 1122' to the crib 22. In all other respects, the operation of the gate sensor 1122' is in accordance with the disclosure of application Ser. No. 09/843,976, including the use of the sound sensor 1153 (e.g., a microphone, or any equivalent device that converts sound into electrical signals) for detecting the sounds of the baby. Thus, for example, the sound sensor 1153 continuously detects the baby sounds and transmits the wireless signal WS representative of the baby sounds to a remotely-located parent unit; in addition, if the crib gate 26 is in an open condition, the switch 52 is activated causing a "crib gate open indication" to be included in the wireless signal WS to the remotely-located parent unit where a crib gate open indicator (e.g., visual and/or audible, etc.) is activated, thereby alerting the parent or caregiver that the crib gate 26 is in an open condition.

Without further elaboration, the foregoing will so fully illustrate our invention that others may, by applying current or future knowledge, readily adopt the same for use under various conditions of service.

We claim:

1. A method for detecting the open condition of a displaceable gate of a crib and detecting the sounds of an infant in the crib, said method comprising the steps of:

coupling a first member comprising a transmitter and a microphone to the crib, said transmitter transmitting a wireless signal to a remote device representative of the sounds of the infant in the crib and said remote device providing an audible version of the sounds of the infant;

coupling a second member to the displaceable gate;

said first member and said second member interacting with each other to modify said wireless signal to include a component representative of the open gate condition whenever the crib gate is opened; and providing an indication at said remote device whenever said component is present in said wireless signal.

2. A method for detecting the movement of a displaceable gate of a crib, said method comprising the steps of:

(a) coupling a first member to the crib;

(b) coupling a second member to the displaceable gate;

(c) said first and second members interfacing to detect the presence of the other without using wires exposed to the crib.

3. A gate sensor for use with a baby crib having a displaceable gate that can be moved into an open or a closed position, said gate sensor detecting the open condition of the displaceable gate, said gate sensor comprising:

a first portion containing an emitter/detector coupled to the crib for emitting a first signal and detecting a second signal;

a second portion coupled to the displaceable gate, said second portion receiving said first signal and reflecting said second signal towards said first portion when the displaceable gate is closed;

said first and second portions having no electrical conductors exposed to the baby crib.

4. A gate sensor for use with a baby crib having a displaceable gate that can be moved into an open or a closed position, said gate sensor detecting the open condition of the displaceable gate, said gate sensor comprising:

a first portion containing an emitter coupled to the crib for emitting a first signal;

a second portion coupled to the displaceable gate, said second portion comprising a detector for detecting said said first signal;

said first and second portions having no electrical conductors exposed to the baby crib.

5. A gate sensor for use with a baby crib having a displaceable gate that can be moved into an open or a closed position, said gate sensor detecting the open condition of the displaceable gate, said gate sensor comprising:

a first portion containing an emitter/detector coupled to the displaceable gate for emitting a first signal and detecting a second signal;

a second portion coupled to the crib, said second portion receiving said first signal and reflecting said second signal towards said first portion when the displaceable gate is closed;

said first and second portions having no electrical conductors exposed to the baby crib.

6. A gate sensor for use with a baby crib having a displaceable gate that can be moved into an open or a closed position, said gate sensor detecting the open condition of the displaceable gate, said gate sensor comprising:

a first portion containing an emitter coupled to the displaceable gate for emitting a first signal;

a second portion coupled to the crib, said second portion comprising a detector for detecting said said first signal;

said first and second portions having no electrical conductors exposed to the baby crib.

* * * * *